United States Patent [19]

Geyken et al.

[11] Patent Number: 4,577,949

[45] Date of Patent: Mar. 25, 1986

[54] DEVELOPING DEVICE FOR A HORIZONTALLY, TRANSPORTED PHOTOGRAPHIC LAYER CARRIER

[75] Inventors: Erwin Geyken, Neubiberg; Franz Heckl, Toeging am Inn; Alfons Kastl, Munich; Klaus Lehnert; Rudolf Loistl, both of Unterhaching, all of Fed. Rep. of Germany

[73] Assignee: Agfa-Gevaert AG, Leverkusen, Fed. Rep. of Germany

[21] Appl. No.: 678,004

[22] Filed: Nov. 30, 1984

[30] Foreign Application Priority Data

Dec. 13, 1983 [DE] Fed. Rep. of Germany ..... 3345084

[51] Int. Cl.[4] ..... G03D 3/02; G03D 3/08

[52] U.S. Cl. ..... 354/319; 354/324; 134/122 P

[58] Field of Search ..... 354/319, 320, 321, 322, 354/324, 325; 134/64 P, 122 P

[56] References Cited

U.S. PATENT DOCUMENTS 3,192,846 7/1965 Wright ..... 134/122 P
3,372,630 3/1968 Schmidt ..... 354/324
3,516,345 6/1970 Meyer ..... 134/64 P
3,545,364 12/1970 Reedy ..... 354/319
3,988,756 12/1976 Wick et al. ..... 354/324

FOREIGN PATENT DOCUMENTS 1293586 12/1969 Fed. Rep. of Germany .

*Primary Examiner*—A. A. Mathews
*Attorney, Agent, or Firm*—Michael J. Striker

[57] ABSTRACT

A developing device for a photographic layer carrier, particularly a film, includes two rotary transport roller pairs transporting a film in a horizontal direction over a bath containing a processing liquid. Two liquid-admitting chambers are positioned opposite to each other in spaced relationship to form a processing space through which the film is transported. Each chamber is subdivided into two portions by a comb-like partition which loosens vortexes generated in one chamber portion upon pumping the liquid thereinto and ensures a uniform distribution of the liquid discharged into the processing space through a slot provided in the second chamber portion.

24 Claims, 3 Drawing Figures

DEVELOPING DEVICE FOR A HORIZONTALLY, TRANSPORTED PHOTOGRAPHIC LAYER CARRIER

BACKGROUND OF THE INVENTION

The present invention relates to a developing apparatus for developing a photographic layer carrier, particularly a sheet film, in which the layer carrier is transported in the horizontal direction between the upper and lower processing chambers by means of two pairs of rotating rollers, of which one pair is arranged at the inlet of the device and another pair of rollers is mounted at the outlet side of the device. A processing liquid is pumped under pressure through a passage extended over about the whole width of each chamber towards the layer carrier movable in the processing space formed between the upper and lower chambers.

The film developing device of the type under discussion is disclosed, for example in German patent No. 1,293,586. Liquid vortexes occur in the fluid passages provided in the known film developing devices of the foregoing type; these vortexes which are generated by non-uniform streams of the processing liquid discharged from the slots, formed in the upper and lower chambers, unfavorably affect the developing process in the region of the layer carrier.

SUMMARY OF THE INVENTION

It is an object of the present invention to provide an improved film developing device.

It is another object of this invention to provide for a uniform stable distribution of the processing liquid in the region of the film being developed.

These and other objects of the invention are attained by a developing device for developing a photographic layer carrier, particularly sheet film, comprising an inlet pair of rotary transport rollers; an outlet pair of rotary transport rollers spaced from said inlet pair, said inlet pair of rollers and said outlet pair of rollers transporting a photographic layer carrier to be developed in the horizontal direction; means forming an upper liquid-admitting chamber and means forming a lower liquid-admitting chamber positioned opposite to each other and spaced from each other to define a processing space therebetween in which the layer carrier is transported, each of said chambers being supplied with a processing liquid under pressure, each means including a passage extended over the entire width of each means and a slot extended over about the entire width of the layer carrier, the processing liquid being admitted through said passage of each means and being discharged through the slot of each means into said processing space towards the layer carrier, each chambr including a comb-like partition means subdividing each chamber into two substantially parallel passage portions, said partition means extending over the length of each chamber and over the width of the layer carrier, the processing liquid being pumped into a first one of said two portions of each chamber, and said slot being formed in a second portion of each chamber.

The first portion of each chamber may be positioned at an inlet side of the device and the second portion of each chamber is positioned at an outlet side of the device.

The first portion of each chamber may be reduced in cross-section in the direction of elongation of said passage.

The second portion of each chamber may have a constant cross-section over the width of each chamber.

Each chamber-forming means may be formed of synthetic plastic material.

Each chamber-forming means may have a trough-shaped wall portion and a cover wall portion connected to each other to enclose said chamber therebetween.

The trough-shaped wall portion may have a reinforcement, said cover wall portion carrying said comb-like partition means, said reinforcement supporting said partition means.

The reinforcement may be formed by a longitudinal rib projecting from the trough-shaped wall portion of each means inwardly of the chamber.

The comb-like partition means may include a plurality of parallel teeth each being an angular element of rectangular cross-section.

Each of said teeth may have a shorter leg extended parallel to the direction of transportation of the layer carrier and having an edge facing towards the trough-shaped wall portion of each chamber-forming means and lying on said longitudinal rib.

The depth of said edge may be equal to the width of the longitudinal rib, said edge and said rib being flush with each other and both merging into said first passage portion.

The device may further include a first additional chamber formed at said inlet side between a lower roller of said inlet pair and said lower processing chamber.

The developing device may further include a first sealing plug positioned in said first additional chamber, said first additional chamber having an upper wall, said first sealing plug abutting against said upper wall and against the lower roller of said inlet pair, said first sealing plug extending over a maximal width of the layer carrier.

The device includes a liquid collecting bath, and a discharge passage for the processing liquid may be formed in said collecting bath between said first additional chamber and said lower chamber.

The device may further include a second additional chamber fromed between said lower chamber and a lower roller of said outlet pair at said outlet side and having an upper wall.

A second sealing plug may be positioned in said second additional chamber and extend over a maximal width of the layer carrier, said plug abutting against the lower roller of said outlet pair and the upper wall of said second additional chamber.

The first and second sealing plug may release further liquid returning passages for the processing liquid, formed respectively before and behind the first and second sealing plug and projecting along the lower rollers of the inlet pair and the outlet pair.

Each chamber-forming means may have a wall means directed towards the layer carrier being transported, said wall means being formed as baffles for the processing liquid discharged through the slot of each chamber forming means.

The developing device may further include means for connecting said lower chamber forming means to said upper chamber forming means in a predetermined position relative to each other. These connecting means may be pins or bolts.

Due to the subdivision of the liquid admitting chamber into two portions by means of the comb-shaped partition it is provided that vortexes, generated in one chamber portion upon pumping of the liquid thereinto are loosened by the teeth of the comb-shaped partition and the liquid is uniformly distributed through the length of the passage and of the slot in the second chamber portion. Thereby a stable, uniform discharge of the liquid from the discharge slot is provided and a uniform distribution of the processing liquid in the processing space is obtained. This effect is even more increased because the teeth of the partition means due to a specific construction are supported on the longitudinal rib provided in each chamber.

Due to the provision of the additional discharge passage the liquid flows into the collecting bath, and there is no disturbance to the processing liquid flowing over the layer carrier takes place in the developing process.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

DETAILED DESCRIPTION OF THE PREFERRED EMBODIMENTS

Figure 1:
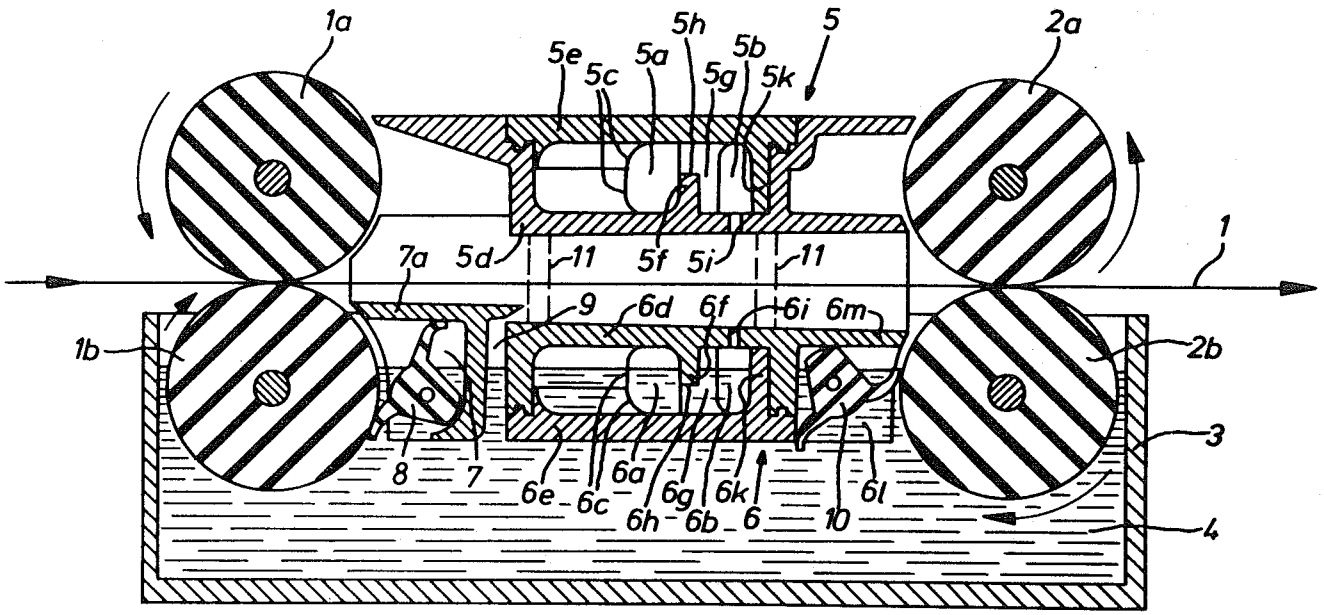
FIG. 1 is a sectional view through a developing device according to the invention in a plane parallel to the direction of movement of a photographic film and, immediately behind feed or supply connections for a processing liquid in inoperative position.

Referring now to the drawings more specifically reference numeral 3 designates a processing bath filled with a processing liquid 4. It is to be understood that only a part of the developing device for a photographic layer carrier, preferably a sheet film, is shown in the drawings for the sake of simplicity. Those structural components of the developing device, which are commonly known, are not depicted in the drawings. The non-illustrated layer carrier or film is transported along a flat displacement path 1 in the direction of arrows A, or from the left to the right in the plane of the drawing by means of two pairs of rotating transport rollers 1*a*, 1*b* and 2*a*, 2*b*. A wet processing device is a developing device in the present invention. The wet processing device can contain not only a developing liquid as a solution in bath 3 but also a fixing solution or a watering solution. Furthermore, the developing device of this invention can be utilized for a sheet film and a roll film as well. Rollers 1*a*, 1*b* are an inlet roller pair and rollers 2*a*, 2*b* are an outlet roller pair. Respective lower rollers 1*b* and 2*b* of both roller pairs are immersed in the supply-and-collecting bath 3 for developing liquid 4. The displacement plane 1 of the layer carrier lies in the plane of the mutual contact between rollers 1*a*, 1*b* or 2*a*, 2*b*.

Figure 2:
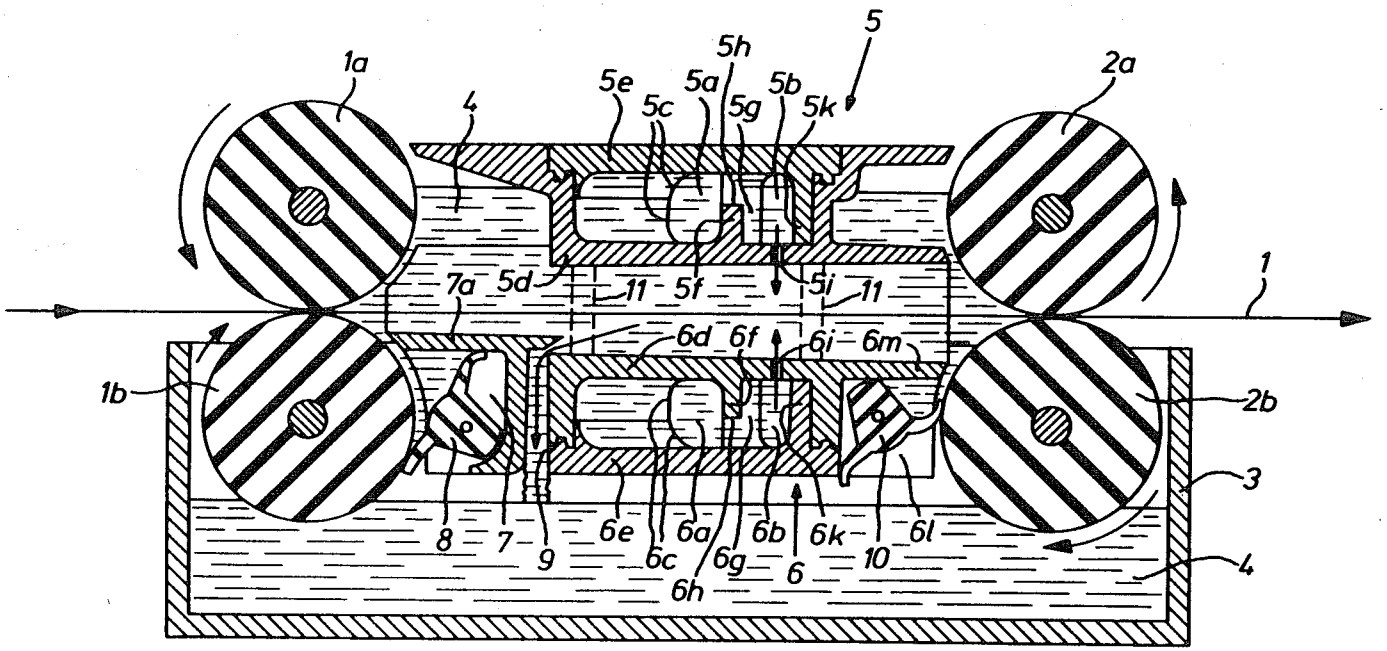
FIG. 2 is a sectional view similar to that of FIG. 1 but of the device in an operative position.

A processing chamber is formed between two roller pairs 1*a*, 1*b* and 2*a*, 2*b*. Two processing chambers, namely an upper processing chamber 5 and a lower processing chamber 6 are arranged in the processing chamber. Both chambers 5 and 6 are mirror-inverted relative to each other. Each chamber 5, 6 has a passage extended parallel to the width of the layer carrier, each of those passages being subdivided into substantially parallel passage portions 5*a*, 5*b* and 6*a*, 6*b*, respectively. Liquid 4 is pumped from bath 3 under considerable pressure into first passage portions 5*a* and 6*a* through a non-shown feed pipe positioned before the sectional plane shown in the drawings. Thereby the liquid 4 from the position shown in FIG. 1 will take the position shown in FIG. 2 and the chambers 5, 6 as well as the processing space formed therebetween will be filled with liquid 4. Each first chamber or passage 5*a*, 6*a* is considerably reduced in cross-section starting from the inlet point for liquid 4 towards the end of the respective passage as shown by contours 5*c*, 6*c*. Such tapered shapes in the passages are normal in order to avoid a pressure drop along the length of the passage.

A further improvement in the proposed arrangement of the liquid conveying passages resides in that each second passage or chamber has a discharge slot for the distribution of liquid 4 on the layer carrier being developed.

Figure 3:
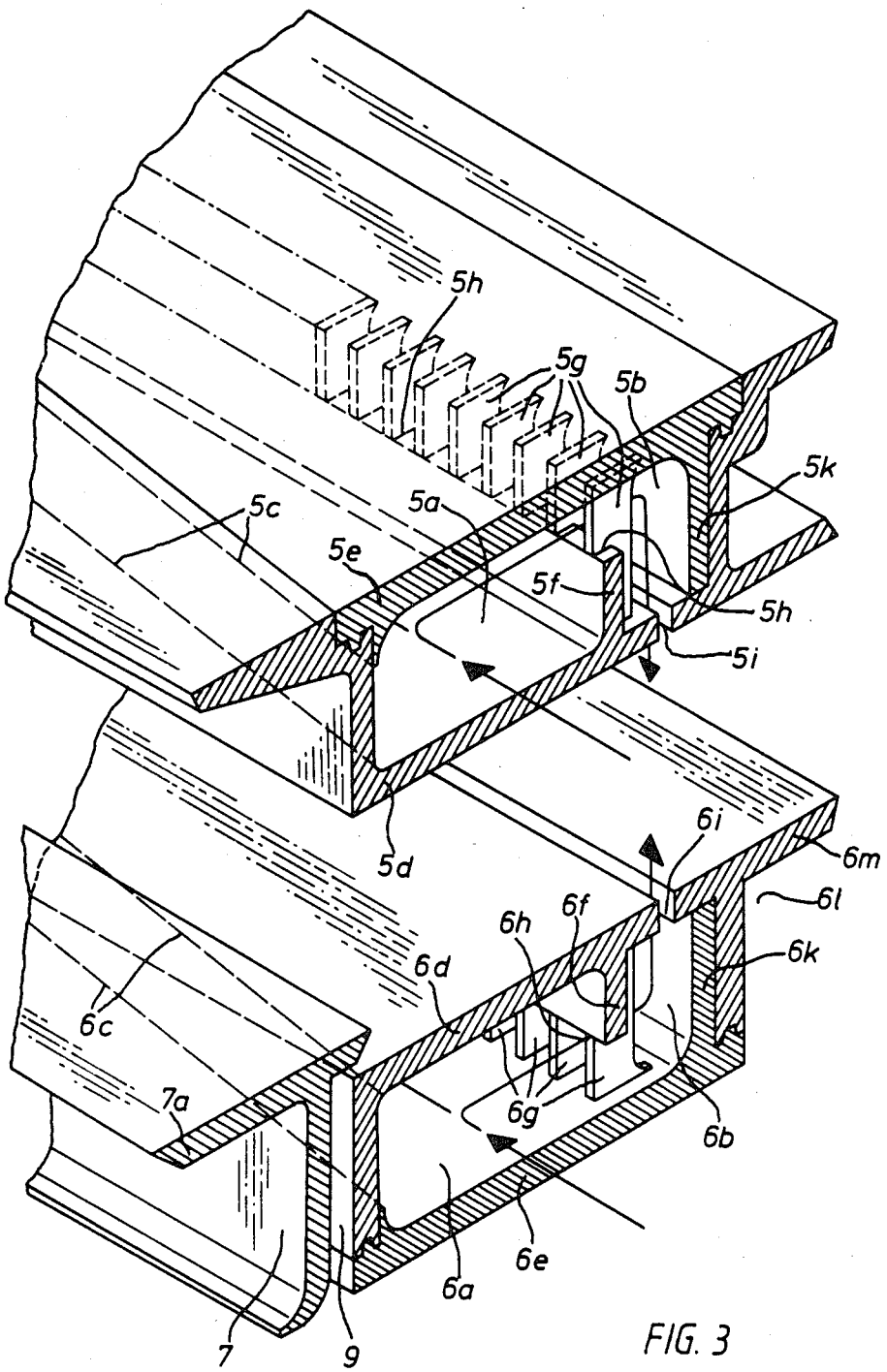
FIG. 3 is a perspective exploded view of the upper and lower processing chambrs shown in FIGS. 1 and 2, on the enlarged scale.

With reference to FIG. 3 it will be seen each passage 5,6 is composed of a trough or tray portion 5*d*, 6*d* facing the layer carrier and a cover 5*e*, 6*e* assembled with the respective trough portion. A longitudinal rib 5*f*, 6*f* extends towards the respective cover 5*e*, 6*e* from the trough portion at the boundary between two chambers 5*a* and 5*b* or 6*a* and 6*b*. Rib 5*f*, 6*f* supports the edges 5*h*, 6*h* of the rectangular cross-section of parallel teeth 5*g*, 6*g* of a comb. Each comb 5*g*, 6*g* projects from the respective cover 5*e*, 6*e* towards the trough portion 5*d*, 6*d*. The discharge slot 5*i*, 6*i* for discharging processing liquid 4 into the processing space between chambers 5 and 6 is provided in the respective second chamber portion 5*b*, 6*b* and extends through the middle longitudinal plane of the second chamber portion.

The operation of the passage arrangement in which each passage 5, 6 is subdivided into two chambers by means of combs 5*g*, 6*g* is as follows:

The proessing liquid 4 which is pumped at a suitable pressure into the first chamber, or, passage portion 5*a*, 6*a* forms in spite of the increasing reduction in cross-section of this chamber a vortex which, when the liquid flows directly from this chamber into the processing space, will cause non-uniform streams and thereby non-uniform liquid distribution. Now, however, the liquid, which is under pressure, will flow first between the teeth of combs 5*g*, 6*g* into the second chamber or passage portion 5*b*, 6*b* whereby the generated vortex will break up and the liquid will be stably and uniformly distributed in the second chamber over the length of this chamber and will also smoothly and unformly flow through the longitudinal slot 5*i*, 6*i* into the processing space at which a uniform distribution of the liquid will be ensured. Due to the arrangement of the two-part liquid supply passage 5*a*, 5*b*; 6*a*, 6*b* and owing to the provision of comb-like separating partition between two parts of each liquid supply chamber a stable and uniform liquid feed into the processing space over the width of the layer carrier and for the entire duration of the developing process will be obtained so that the quality of the developing process will be substantially improved.

The shape each liquid-processing passage 5, 6 is not limited to a specific embodiment. It is advantageous that the depth of each edge 5*h*, 6*h* of the each tooth of the comb is equal to the width of the longitudinal rib 5*f*, 6*f* and that the edge of each tooth and the rib are flush with each other and merge into the first chamber 5*a*, 5*b*. Furthermore, although it is not necessary it is possible to provide a structure in which the teeth of the combs would extend through the entire height of the passage if it is proper with another dimensions of the liquid supply passage. The teeth of the combs are spaced at equal intervals from each other for the reasons of manufacturing. However, instead of the reduced cross-section of the first passage portion 5*a*, 6*a* or in addition to such a shape of the first passage portion the teeth of the combs can lie closely to each other at the beginning of the channel and at the discharge region, or in the area of higher pressures and greater resistance to those pressures on the contrary at greater intervals from each other. Also the joint portions extended from the through portions and cover portions 5*d*, 5*e* and 6*d*, 6*e* can be formed by sealing rings instead of labyrinth-like projections and recesses shown in the drawings. The second passage portion or chamber 5*b*, 6*b* as shown in the drawings, is limited in the longitudinal direction on the one hand, by the teeth 5*g*, 6*g* and ribs 5*f*, 6*f* and, on the other hand, by projections 5*k*, 6*k* which are provided on the respective cover portion and extend towards the bottom of the respective trough portion. It is also possible to omit projections 5*k*, 6*k* at this side of the passage portion 5*b*, 6*b* and to form the inner wall of the cover portion so that it would extend to the respective wall of the trough portion or to the teeth forming the labyrinth.

Since the uniform liquid distribution in the processing space is obtained by the arrangement of the passages in comb-like partitions 5*f*, 5*g* it is possible to provide the return of the processing liquid into bath 3 by the shape or the arrangement of the discharge passages.

It is also advantageous that a further chamber 7 is provided between the lower passage or chamber 6 and the lower roller 1*b* of the inlet transport roller pair 1*a*, 1*b*. A sealing plug 8 abutting against the lower roller 1*b* and the upper covering portion 7*b* of the additional chamber 7 is positioned in this additional chamber 7; sealing plug 8 extends over the maximally possible width of the photographic layer carrier and does not extend over the entire width of the roller. A liquid returning passage 9 for returning the processing liquid 4 into bath 3 is formed between the lower passage or chamber 6 and the additional chamber 7. Passage 1 extends over the entire width of the photographic layer carrier. Since the sealing plug 8 extends over the maximal width of the photographic layer carrier the processing liquid 4 can drain in the region of the layer carrier, transported through the processing space, only through passage 9 whereas the return flow in the processing space along the lower roller 1*b* is prevented by the sealing plug 8. Only the liquid flowing laterally over the photographic layer carrier can drain along the edges of lower roller 1*b* along the side of the cylindrical plug 8 and downwardly into bath 3. Furthermore, the upper wall of lower passage 6, facing the photographic layer carrier, extends laterally beyond both passage portions 6*a*, 6*b* so as to form a cover portion 6*m* which encloses a further chamber 61 in which another sealing plug 10 is located, which abuts against the periphery of lower outer roller 2*b* and the edge of cover portion 6*e*. The length of sealing plug 10 also corresponds to the maximal width of the photographic layer carrier. It is also obtained thereby that liquid in the region of the layer carrier transported through the processing space can drain only through passage 9 and can pass over the layer carrier and flow then laterally of sealing plug 10 into the edges of roller 2*b* back into bath 3. Therefore the walls of chambers 5 and 6 facing the photographic layer carrier act as liquid conveying surfaces for the liquid flowing through slots 5*i* and 6*i*.

It is understandable that the manufacture of chambers or passages 5,6 having one portion or two portions or many portions is performed in accordance with specific shapes thereof; chamber 7 can be formed as a portion of chamber 6 with the release of passage 9. Furthermore, it is expedient that suitable conventional means be provided which should serve to exactly set the upper and lower chamber 5 and 6 relative to each other in the device after they have been disconnected from each other for cleaning. For this purpose pins or bolts 11 are provided which extend in respective bores formed in the walls forming the chambers 5, 6. The defined discharge passages, for example passage 9 and important sealing stoppers or plugs 8 and 10 as well as the correct position of chambers 5 and 6 relative to each other and the provision of the combs 5*g*, 6*b* within the chambers ensure the uniform distribution of the processing liquid in the processing space and therefore substantially improve the stability of the film development.

It will be understood that each of the elements described above, or two or more together, may also find a useful application in other types of developing devices differing from the types described above.

While the invention has been illustrated and described as embodied in a developing device for a photographic layer carrier it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, farily constitute essential characteristics of the generic or specific aspects of this invention.

What is claimed as new and desired to be protected by Letters Patent is set forth in the appended claims.

1. A developing device for developing a photographic layer carrier, particularly sheet film, comprising an inlet pair of rotary transport rollers; an outlet pair of rotary transport rollers spaced from said inlet pair, said inlet pair of rollers and said outlet pair of rollers transporting a photographic layer carrier to be developed in the horizontal direction; means forming an upper liquid-admitting chamber and means forming a lower liquid-admitting chamber positioned opposite to each other and spaced from each other to define a processing space therebetween in which the layer carrier is transported, each of said chambers being supplied with a processing liquid under pressure, each means including a passage extended over the entire width of each means and a slot extended over about the entire width of the layer carrier, the processing liquid being admitted through said passage of each means and being discharged through the slot of each means into said processing space towards the layer carrier, each chamber including a comb-like partition means subdividing each chamber into two substantially parallel passage portions, said partition means extending over the length of each chamber and over the width of the layer carrier, the processing liquid being pumped into a first one of said two portions of each chamber, and said slot being formed in a second portion of each chamber.

2. The device as defined in claim 1, wherein the first portion of each chamber is positioned at an inlet side of the device and the second portion of each chamber is positioned at an outlet side of the device.

3. The device as defined in claim 2, wherein the first portion of each chamber is reduced in cross-section in the direction elongation of said passage.

4. The device as defined in claim 2, wherein the second portion of each chamber has a constant cross-section over the width of each chamber.

5. The device as defined in claim 4, said second portion having a middle longitudinal plane, said slot extending through said middle longitudinal plane.

6. The device as defined in claim 4, wherein each means may be formed of synthetic plastic material.

7. The device as defined in claim 4, wherein each means has trough-shaped wall portion and a cover wall portion connected to each other to enclose a respective chamber therebetween.

8. The device as defined in claim 7, wherein said trough-shaped wall portion has a reinforcement, said cover wall portion carrying said comb-like partition means, said reinforcement supporting said partition means.

9. The device as defined in claim 8, wherein said reinforcement is formed by a longitudinal rib projecting from the trough-shaped wall portion of each means inwardly of the chamber.

10. The device as defined in claim 9, wherein said comb-like partition means include a plurality of parallel teeth each being an angular element of rectangular cross-section.

11. The device as defined in claim 10, wherein each of said teeth has shorter leg extended parallel to the direction of transportation of the layer carrier and having an edge facing towards the trough-shaped wall portion of each chamber-forming means and lying on said longitudinal rib.

12. The device as defined in claim 11, wherein the depth of said edge is equal to the width of the longitudinal rib, said edge and said rib being flush with each other and both merging into said first passage portion.

13. The device as defined in claim 11, further including a first additional chamber formed at said inlet side between a lower roller of said inlet pair and said lower processing chamber.

14. The device as defined in claim 13, further including a first sealing plug positioned in said first additional chamber, said first additional chamber having an upper wall, said first sealing plug abutting against said upper wall and against the lower roller of said inlet pair, said first sealing plug extending over a maximal width of the layer carrier.

15. The device as defined in claim 14, further including a liquid supply-and-collecting bath.

16. The device as defined in claim 15, wherein a discharge passage for the processing liquid is formed in said liquid collecting bath between said first additional chamber and said lower chamber.

17. The device as defined in claim 16, further including a second additional chamber formed between said lower chamber and a lower roller of said outlet pair at said outlet side and having an upper wall.

18. The device as defined in claim 17, further including a second sealing plug positioned in said second additional chamber and extended over a maximal width of the layer carrier and abutting against the lower roller of said outlet pair and the upper wall of said second additional chamber.

19. The device as defined in claim 18, wherein said first and second sealing plug release further liquid-returning passages for the processing liquid formed respectively before and behind the first and second sealing plug and projecting along the lower rollers of the inlet pair and the outlet pair.

20. The device as defined in claim 19, wherein at least one of said additional chambers is formed on said lower chamber.

21. The device as defined in claim 19, wherein each chamber-forming means has a wall means directed towards the layer carrier being transported, said wall means being formed as baffles for the processing liquid discharged through the slot of each chamber-forming means.

22. The device as defined in claim 20, further including means for connecting said lower chamber forming means to said upper chamber forming means in a predetermined position relative to each other.

23. The device as defined in claim 22, wherein said connecting means are pins.

24. The device as defined in claim 22, wherein said connecting means are bolts.

* * * * *